US006161344A

United States Patent [19]

Blanchett

[11] Patent Number: 6,161,344

[45] Date of Patent: Dec. 19, 2000

[54] WATER-PROOF WINDOW FLANGE

[76] Inventor: Paul T. Blanchett, 22905 41st Pl. W., Mountlake Terrace, Wash. 98043

[21] Appl. No.: 09/260,464

[22] Filed: Mar. 2, 1999

[51] Int. Cl.[7] ..... E06B 1/34

[52] U.S. Cl. ..... 52/97; 52/204.2; 52/208; 52/211; 52/656.5; 52/730.6; 52/734.1

[58] Field of Search ..... 52/97, 211, 204.2, 52/208, 656.5, 730.6, 734.1

[56] References Cited

U.S. PATENT DOCUMENTS

| | | | |
|---|---|---|---|
| 2,755,894 | 7/1956 | Weyl et al. | 52/97 |
| 3,139,703 | 7/1964 | Hilt | 52/97 |
| 3,416,271 | 12/1968 | Heeney | 52/97 X |
| 4,055,916 | 11/1977 | Yamamoto et al. | 52/97 X |
| 5,660,010 | 8/1997 | Sayers | 52/211 X |
| 5,758,458 | 6/1998 | Ridge | 52/211 X |
| 5,916,095 | 6/1999 | Tamlyn | 52/97 X |

*Primary Examiner*—Christopher T. Kent

*Attorney, Agent, or Firm*—Jack Lo

[57] ABSTRACT

A water-proof window flange is of an elongated, extruded shape. In an end view, it includes a vertical first member, a horizontal second member extending forwards orthogonally from an intermediate position on the vertical member, and a third member extending backwards from a forward end of the horizontal second member. An inner end of the third member is positioned below and forward of a lower end of the first member. The top end of the vertical first member is for being positioned between a siding and subsiding of a wall. The bottom end of the vertical first member is for being positioned on top of a window frame. The inner end of the third member is for being positioned in front of the window frame, and below a top edge of the window frame. The top of the vertical first member is positioned far above the lower edge of the siding to prevent rain water from seeping around the top of the window flange. The lower end of the third member is positioned below the top front edge of the window frame to prevent rain water from seeping under the window flange and around the top of the window frame.

3 Claims, 3 Drawing Sheets

WATER-PROOF WINDOW FLANGE

BACKGROUND OF THE INVENTION

1. Field of the Invention

This invention relates generally to window frames and flanges.

2. Prior Art

FIG. 1 is a sectional view showing a conventional aluminum window frame 10 attached to a wall 11 in a typical installation. Wall 11 includes on its interior a drywall 12 and a casing 13. A liner 14 is attached to the perimeter of the window opening. Sidings 15 are attached in front of a subsiding 16, which is attached to a header 17. Window frame 10 includes a vertical nailing flange 18 inserted between siding 15 and subsiding 16, and a horizontal member 19 extending forwardly from the lower edge of nailing flange 18. Rain water, as indicated by the dashed arrow, hitting horizontal member 19 can seep under siding 15, but is prevented by nailing flange 18 from entering wall 11.

Aluminum windows are often replaced by vinyl windows, which are structurally very different. A common replacement method involves collapsing the aluminum window frame, and attaching a vinyl window frame 20 in front of liner 14 and below siding 15, as shown in FIG. 2. Caulking 21 is applied to a joint between vinyl window frame 20 and siding 15 to prevent water entry.

However, caulking 21 is sometimes improperly applied. Even when caulking 21 is properly applied, it will eventually fail and separate from window frame 20 and/or siding 15, and provide a path for rain water to seep into the inside of the window, as indicated by the dashed arrow.

As shown in FIG. 3, another common replacement method involves cutting siding 15 and subsiding 16 to expose the nailing flange of the original aluminum window frame, removing the aluminum window frame, adding a wood trim filler 22 under siding 15 and subsiding 16, and attaching a vinyl window frame 23 under liner 14 and filler 22. Although a vertical nailing flange 24 is provided on some vinyl window frames, it is positioned below caulking 21, so that it cannot prevent rain water seepage when caulking 21 fails. A path for rain water seepage to the inside of the window is indicated by the dashed arrow.

OBJECTS OF THE INVENTION

Accordingly, objects of the present water-proof window flange are:

- to prevent rain water from seeping into the inside of a window;
- to eliminate the need for caulking;
- to be easily nailed to a wall;
- to eliminate the need for cutting the siding and subsiding; and
- to eliminate the need for trim pieces.

Further objects of the present invention will become apparent from a consideration of the drawings and ensuing description.

BRIEF SUMMARY OF THE INVENTION

A water-proof window flange is of an elongated, extruded shape. In an end view, it includes a vertical first member, a horizontal second member extending forwards orthogonally from an intermediate position on the vertical member, and a third member extending backwards from a forward end of the horizontal second member. An inner end of the third member is positioned below and forward of a lower end of the first member. The top end of the vertical first member is for being positioned between a siding and subsiding of a wall. The bottom end of the vertical first member is for being positioned on top of a window frame. The inner end of the third member is for being positioned in front of the window frame, and below a top edge of the window frame. The top of the vertical first member is positioned far above the lower edge of the siding to prevent rain water from seeping around the top of the window flange. The lower end of the third member is positioned below the top front edge of the window frame to prevent rain water from seeping under the window flange and around the top of the window frame.

DRAWING REFERENCE NUMERALS

| | |
|---|---|
| 10. Aluminum Window Frame | 11. Wall |
| 12. Drywall | 13. Casing |
| 14. Liner | 15. Sidings |
| 16. Subsiding | 17. Header |
| 18. Nailing Flange | 19. Horizontal Flange |
| 20. Vinyl Window Frame | 21. Caulking |
| 22. Trim | 23. Vinyl Window Frame |
| 24. Nailing Flange | 25. Vertical First Member |
| 26. Horizontal Second Member | 27. Third Member |
| 28. Brackets | 29. Tube |
| 30. Vinyl Window Frame | 31. Short Vertical Flange |
| 32. Vinyl Window Frame | 33. Tall Vertical Stucco Flange |
| 34. Channel | 35. Bore Hole |

DETAILED DESCRIPTION OF THE INVENTION

Figure 4:
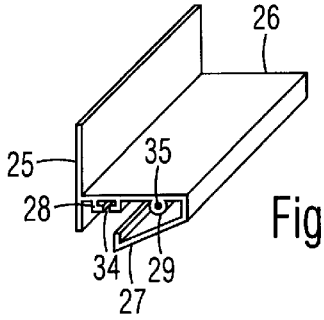
FIG. 4 is an end perspective view of a water-proof window flange.

FIG. 4:

A preferred embodiment of the water-proof window flange is shown in an end perspective view in FIG. 4. It is of an elongated, extruded shape. It includes a vertical first member 25, a horizontal second member 26 extending forwards orthogonally from an intermediate position on vertical first member 25, and a third member 27 extending backwards from a forward end of horizontal second member 26. An inner end of third member 27 is positioned below and forward of a lower end of vertical first member 25.

The elongated window flange can be cut to any length desired, usually with angled ends for forming a rectangular frame. A pair of L-shape brackets 28 are arranged under horizontal second member 26. Brackets 28 mirror each other to define a channel 34 between them for receiving a rightangled corner key for aligning orthogonally adjoining window flanges. A tube 30 defining a bore hole 35 therein is also arranged under horizontal second member 26 for securing adjoining flanges together with screws extending into bore hole 35.

Figure 1:
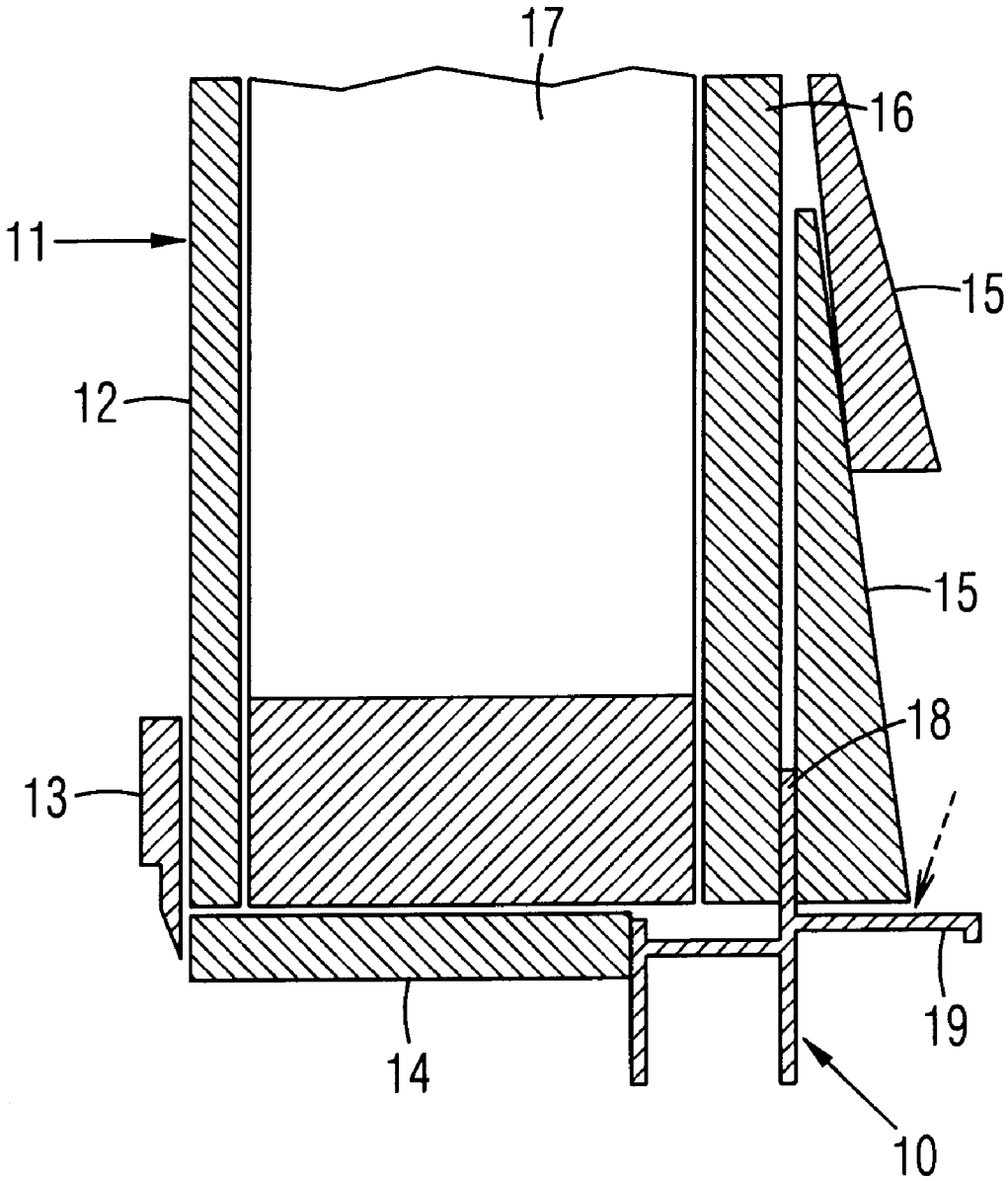
Fig. 1 Prior Art
FIG. 1 is a sectional view of a prior art aluminum window frame installed in a wall.
Figure 2:
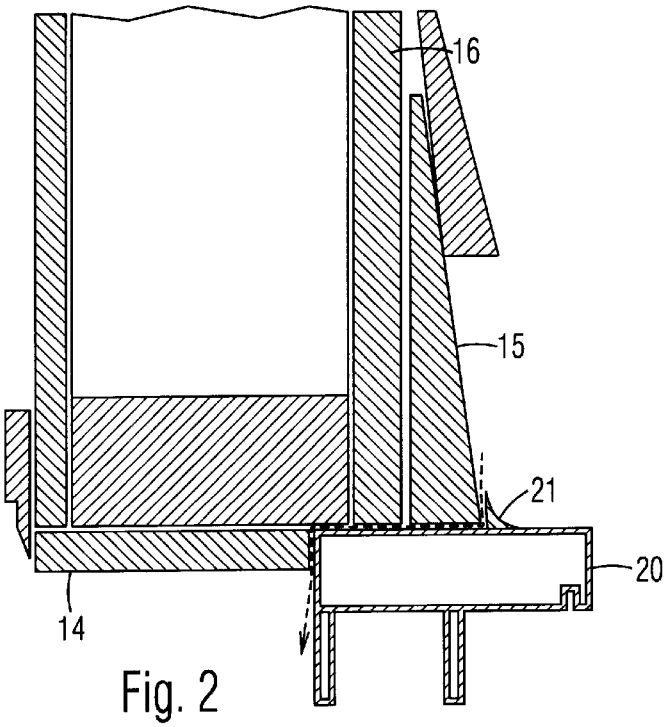
Fig. 2 Prior Art
FIG. 2 is a sectional view of a first type of prior art vinyl window frame installation.
Figure 3:
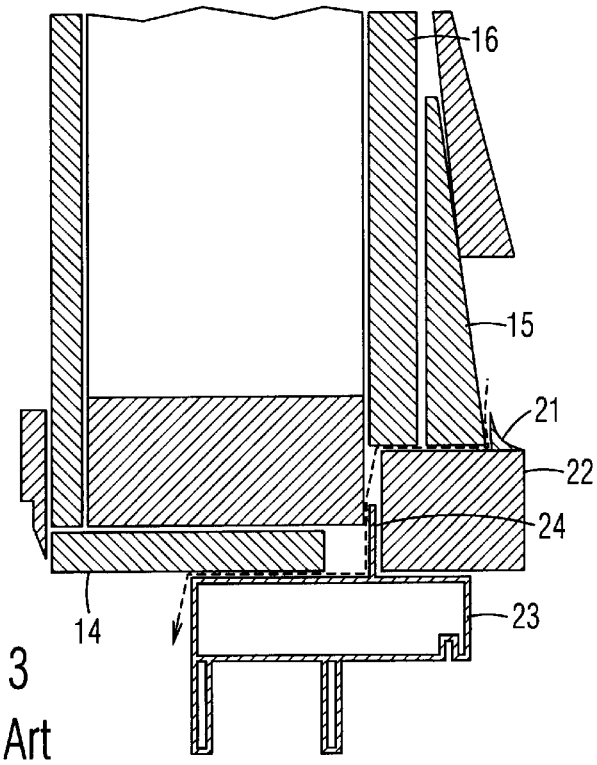
Fig. 3 Prior Art
FIG. 3 is a sectional view of a second type of prior art vinyl window frame installation.
Figure 5:
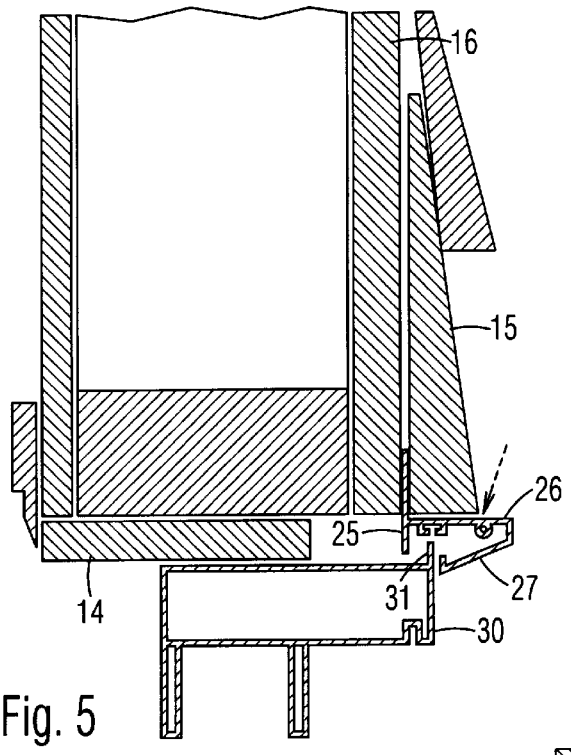
FIG. 5 is a sectional view of the water-proof window flange in a first type of installation around a vinyl window frame.

FIG. 5:

After a conventional aluminum window frame is removed, the water-proof window flange is preferably installed around the window opening without cutting siding 15 and subsiding 16, as shown in FIG. 5. The top end of vertical first member 25 is positioned between siding 15 and subsiding 16 and nailed in place. The top surface of horizontal second member 26 is positioned against the bottom of siding 15. A conventional vinyl window frame 30 with a trimmed (as necessary) stucco fin is attached to the inside of liner 14, so that a short vertical flange 31 at its top front edge is positioned against and slightly above the inner end of third member 27. The top end of vertical first member 25 is positioned far above the lower end of siding 15, so that rain water, as indicated by the dashed arrow, is prevented by vertical first member 25 from seeping around the top of the window flange. The inner end of third member 27 is positioned slightly below the top front edge of vinyl window frame 30, so that rain water is prevented from seeping around the bottom of the window flange. Waterproofing is thus provided without caulking. Also, siding 15 is left in its original condition to eliminate the need for repainting and additional trim pieces.

Figure 6:
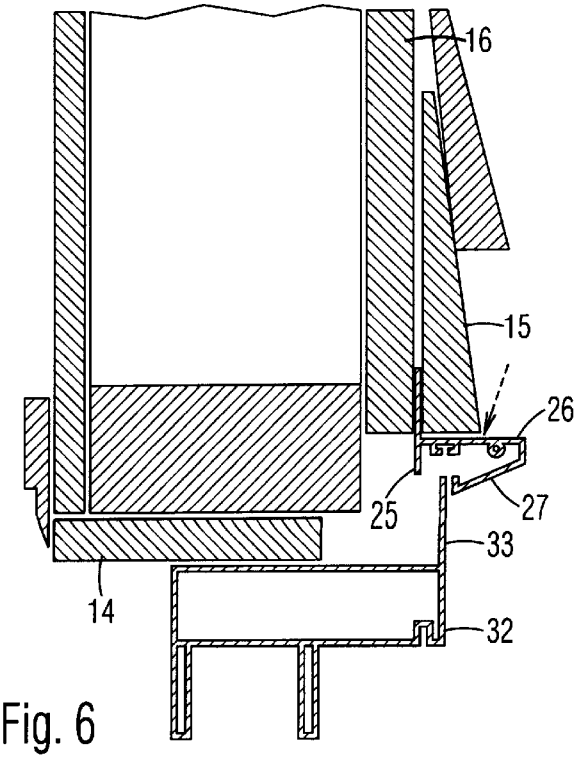
FIG. 6 is a sectional view of the water-proof window flange in a second type of installation around a vinyl window frame.

FIG. 6:

Many conventional aluminum window frames have a stepped shoulder on their upper surface that necessitate cutting back siding 15 and subsiding 16. Also, some workers prefer to cut back siding 15 and subsiding 16 to more easily remove the original aluminum window frame. When this is done, a conventional vinyl window frame 32 with a slightly trimmed or untrimmed tall stucco flange 33 is used, as shown in FIG. 6. The top end of vertical first member 25 is positioned between siding 15 and subsiding 16 and nailed thereto. High profile vinyl window frame 32 is attached to the inside of liner 14 so that tall vertical stucco flange 33 at its top front edge is positioned against and slightly above the inner end of third member 27. The top end of vertical first member 25 is positioned far above the lower end of siding 15, so that rain water, as indicated by the dashed arrow, is prevented by vertical first member 25 from seeping around the top of the window flange. The inner end of third member 27 is positioned slightly below the top front edge of vinyl window frame 32, so that rain water is prevented from seeping around the bottom of the window flange. Again, waterproofing is provided without caulking. The need for trim pieces is also eliminated.

SUMMARY AND SCOPE

Accordingly, a water-proof window flange is provided. It prevents rain water from seeping into the inside of the wall. It eliminates the need for caulking. It is easily nailed to a wall. It eliminates the need for cutting the siding and subsiding. It eliminates the need for trim pieces. It also allows the use of conventional window frames.

Although the above description is specific, it should not be considered s a limitation on the scope of the invention, but only as an example of the preferred embodiment. Many variations are possible within the teachings of the invention. For example, horizontal second member 26 can be attached to the lower end of vertical first member 25. Third member 27 can be completely horizontal or more slanted, as long as its inner end is generally kept in the same position relative the lower end of vertical first member 25. The window flange can be used with other types of window frames. Therefore, the scope of the invention should be determined by the appended claims and their legal equivalents, not by the examples given.

I claim:

1. An elongated water-proof window flange, comprising:

a vertical first member with a front side and a back side;

a horizontal second member extending forwards orthogonally from said front side of said vertical first member; and a third member extending backwards from a forward end of said horizontal second member, an inner end of said third member being positioned below and forward of a bottom end of said vertical first member;

a top end of said vertical first member for being positioned between a siding and a subsiding of a wall, said bottom end of said vertical first member for being positioned on top of a window frame, said inner end of said third member for being positioned in front of said window frame, said top end of said vertical first member for being positioned above a bottom end of said siding for preventing rain water from seeping around said vertical first member, said inner end of said third member for being positioned below a top front edge of said window frame for preventing rain water from seeping around said window frame.

2. An elongated water-proof window flange, comprising:

a flat vertical first member for convenient nailing, said vertical first member having a front side and a back side;

a flat horizontal second member extending forwards orthogonally from an intermediate position on said front side of said vertical first member, so that a bottom end of said vertical first member projects below said horizontal second member; and a third member extending backwards at a downward angle from a forward end of said horizontal second member, an inner end of said third member being positioned below and forward of said bottom end of said vertical first member;

a top end of said vertical first member for being positioned between a siding and a subsiding of a wall, said bottom end of said vertical first member for being positioned on top of a window frame, said inner end of said third member for being positioned in front of said window frame, said top end of said vertical first member for being positioned above a bottom end of said siding for preventing rain water from seeping around said vertical first member, said inner end of said third member for being positioned below a top front edge of said window frame for preventing rain water from seeping around said window frame.

3. An elongated water-proof window flange, comprising:

a vertical first member with a front side and a back side;

a horizontal second member extending forwards orthogonally from said front side of said vertical first member;

a third member extending backwards from a forward end of said horizontal second member, an inner end of said third member being positioned below and forward of a bottom end of said vertical first member;

a channel on said horizontal second member for receiving a corner-key for aligning orthogonally adjoining window flanges; and a bore hole on said horizontal second member for receiving a screw for securing said adjoining window flanges together;

a top end of said vertical first member for being positioned between a siding and a subsiding of a wall, said bottom end of said vertical first member for being positioned on top of a window frame, said inner end of said third member for being positioned in front of said window frame, said top end of said vertical first member for being positioned above a bottom end of said siding for preventing rain water from seeping around said vertical first member, said inner end of said third member for being positioned below a top front edge of said window frame for preventing rain water from seeping around said window frame.

* * * * *